US006614166B2

(12) United States Patent
Hilscher et al.

(10) Patent No.: US 6,614,166 B2
(45) Date of Patent: Sep. 2, 2003

(54) DISCHARGE LAMP HAVING SPRING

(75) Inventors: Achim Hilscher, Friedberg-Stätzling (DE); Thomas Noll, Kipfenberg (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 14 days.

(21) Appl. No.: 10/013,502

(22) Filed: Dec. 13, 2001

(65) Prior Publication Data

US 2002/0074940 A1 Jun. 20, 2002

(30) Foreign Application Priority Data

Dec. 20, 2000 (DE) ..... 100 63 958

(51) Int. Cl.[7] ..... H01J 63/04
(52) U.S. Cl. ..... 313/493; 313/634; 313/292
(58) Field of Search ..... 313/493, 634, 313/269, 292, 318.01

(56) References Cited

U.S. PATENT DOCUMENTS

| | | | | | |
|---|---|---|---|---|---|
| 4,508,993 | A | * | 4/1985 | Anderson | 313/493 |
| 4,853,591 | A | * | 8/1989 | Klein et al. | 313/493 |
| 6,064,152 | A | | 5/2000 | Hammer et al. | |
| 6,437,502 | B1 | * | 8/2002 | Nishio et al. | 313/493 |

* cited by examiner

*Primary Examiner*—Vip Patel
(74) *Attorney, Agent, or Firm*—Carlo S. Bessone

(57) ABSTRACT

The compact low-pressure discharge lamp (1) has a wound tubular discharge vessel (2) with at least four straight tubes (6, 7) which are in a polygonal arrangement and, close to or at the ends of the straight tubes (6, 7), are connected by transverse connections (8, 10, 11) to form a single continuous discharge path which is closed off in a gastight manner. A coil spring (14) made from metal, which runs parallel to the tubes (6, 7) is arranged in the center of the cylindrical cavity (13) formed by the straight tubes (6, 7) of the discharge vessel (2). The coil spring (14) reduces the firing voltage required.

7 Claims, 2 Drawing Sheets

DISCHARGE LAMP HAVING SPRING

TECHNICAL FIELD

The invention is based on a compact low-pressure discharge lamp in accordance with the preamble of claim 1. This is in particular a compact low-pressure discharge lamp having a discharge vessel comprising at least four straight, parallel tubes which are arranged in a polygon and, at or close to the ends of the straight tubes, are connected by transverse connections to form a single continuous discharge path which is closed off in a gastight manner.

PRIOR ART

The compact low-pressure discharge lamps having a discharge vessel which comprises four or more straight, parallel tubes and is assembled by means of transverse connections, depending on the length and the diameter of the discharge vessel and on the internal diameter of the transverse connections, often require very high voltages to be fired reliably.

It is known from U.S. Pat. No. 6,064,152 to introduce a hollow cylinder made from electrically conductive material in the form of a metal foil into the hollow interior formed by the straight, parallel tubes of the discharge vessel. This allows the firing voltage of the lamp to be reduced considerably.

However, a drawback is that a metal cylinder of this type absorbs a large proportion of the light which is radiated inward from the discharge vessel, and this light is therefore lost. Moreover, a metal cylinder of this type changes the temperature balance of the lamp. For example, the metal cylinder leads to an increase in the cold-spot temperature, which in turn leads to a shift in the radiation maximum toward lower ambient temperatures.

SUMMARY OF THE INVENTION

Therefore, it is an object of the invention to provide a compact low-pressure discharge lamp with a reduced firing voltage which allows the light which is radiated into the cavity formed by the straight tubes and the transverse connections of the discharge vessel to pass substantially without being impeded.

In a compact low-pressure discharge lamp having the features of the preamble of claim 1, this object is achieved by the features of the characterizing part of claim 1. Particularly advantageous configurations are listed in the dependent subclaims.

A metal coil spring means that the space inside the straight tubes of the discharge vessel remains substantially clear. Consequently, most of the radiation which is emitted into the central cavity between the straight tubes of the discharge vessel can pass without being impeded or can pass back out after having been reflected one or more times from the discharge vessel walls. Moreover, the temperature balance of the low-pressure discharge lamp is only affected to an insignificant extent.

In a preferred embodiment, the coil spring may have a reflective coating. This enables the radiation which is emitted into the center of the discharge vessel and impinges on the coil spring to be partially radiated back outward, so that the radiation loss caused by the introduction of the coil spring is reduced further. The coating preferably has a reflectivity which corresponds to that of the phosphor-coated discharge vessel.

The coil spring advantageously consists of wire, a wire diameter of between 0.05 and 1 mm being selected, depending on the extent to which it is necessary to reduce the firing voltage.

The extent to which the firing voltage is reduced can be set by means of the number of turns of the coil spring which bear against the walls of the straight tubes of the discharge vessel. In this connection, it is merely necessary to match the diameter of the number of turns of the coil spring which are to bear against the discharge vessel to the diameter of the cavity.

The pitch factor PF, i.e. the ratio of the distance between two adjacent wire turns to the diameter of the wire, determines the number of wire turns which a coil spring of a defined length possesses. The number of turns of the coil spring can in turn be used to define the extent to which the firing voltage is reduced. In a preferred embodiment, therefore, the coil spring has a pitch factor PF of $1.5<PF<70$.

To securely hold the coil spring in the cavity between the straight tubes, the coil spring, in the stress-free state, preferably has a starting length which is between one and five times the distance between the transverse connections of the discharge vessel at the end remote from the cap housing and that end of the cap housing which faces the discharge vessel. Moreover, the last turn or last turns of the coil spring at the end remote from the cap housing preferably has or have a diameter which is such that they bear against all the walls of the straight tubes. This allows the coil spring to be clamped between the cap housing and that outer wall of the transverse connections remote from the cap housing which faces the cap housing, so that it is held securely between the parts of the discharge vessel.

DESCRIPTION OF THE DRAWINGS

The invention is to be explained in more detail below with reference to a plurality of exemplary embodiments. In the drawing.

Figure 1:
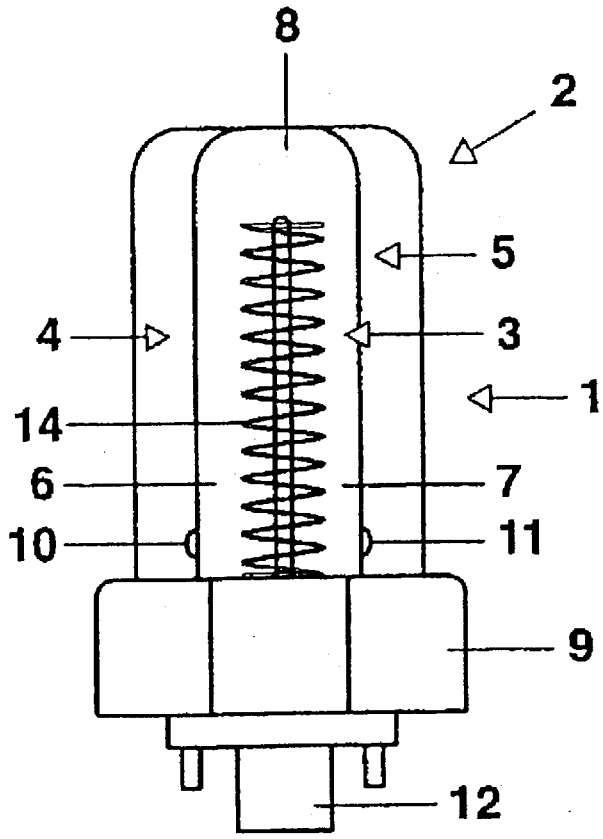
FIG. 1 shows a side view of a compact low-pressure discharge lamp according to the invention with an inserted coil spring.
Figure 2:
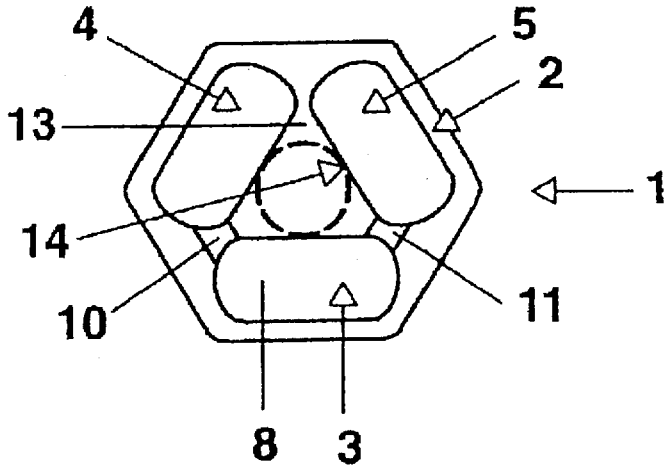
FIG. 2 shows a plan view of the compact low-pressure discharge lamp according to the invention with coil spring as illustrated in FIG. 1.

The lamp 1 illustrated in FIGS. 1 and 2, with a power consumption of 42 W, has a discharge vessel 2 made from glass which is assembled from three pieces 3, 4, 5 which are curved in a U shape, each piece 3, 4, 5 in turn comprising two straight tubes 6, 7 which are circular in cross section (external diameter 12 mm), and a transverse connection in the form of a right-angled 180° bend 8. In plan view, the three pieces 3, 4, 5 are arranged in the shape of a triangle and, close to a cap housing 9 made from plastic, are connected to one another via transverse connections in the form of transverse fused joins 10, 11 likewise made from glass. The free ends of the straight tubes 6, 7 of the three pieces 3, 4, 5 are sealed in a gastight manner (not visible here) and are held in the cap housing 9. Moreover, in each case one electrode (not visible) is fused into the two ends of the discharge vessel 2, and the inner wall of the vessel 2 is provided with a phosphor coating. At its end which is remote from the discharge vessel 2, the cap housing 9 bears a contact-making system 12 in the form of a cap of type GX24q-3.

A coil spring 14 is introduced into the cavity 13 formed by the three pieces 3, 4, 5 of the discharge vessel 2. The coil spring 14 consists of spring steel with a wire diameter of 0.5 mm. The coil spring 14 is clamped in the lamp 1 between the upper end wall of the cap housing 9 and that outer wall of the 180° bend 8 which faces the cap housing 9, and all its turns bear against the straight tubes 6, 7 of the discharge vessel 2. In the clamped state, it has a turn spacing of 5 mm and therefore a pitch factor PF of 10. The length of the clamped coil spring 14 is 93 mm, and its external diameter is 15.4 mm.

Figure 3:
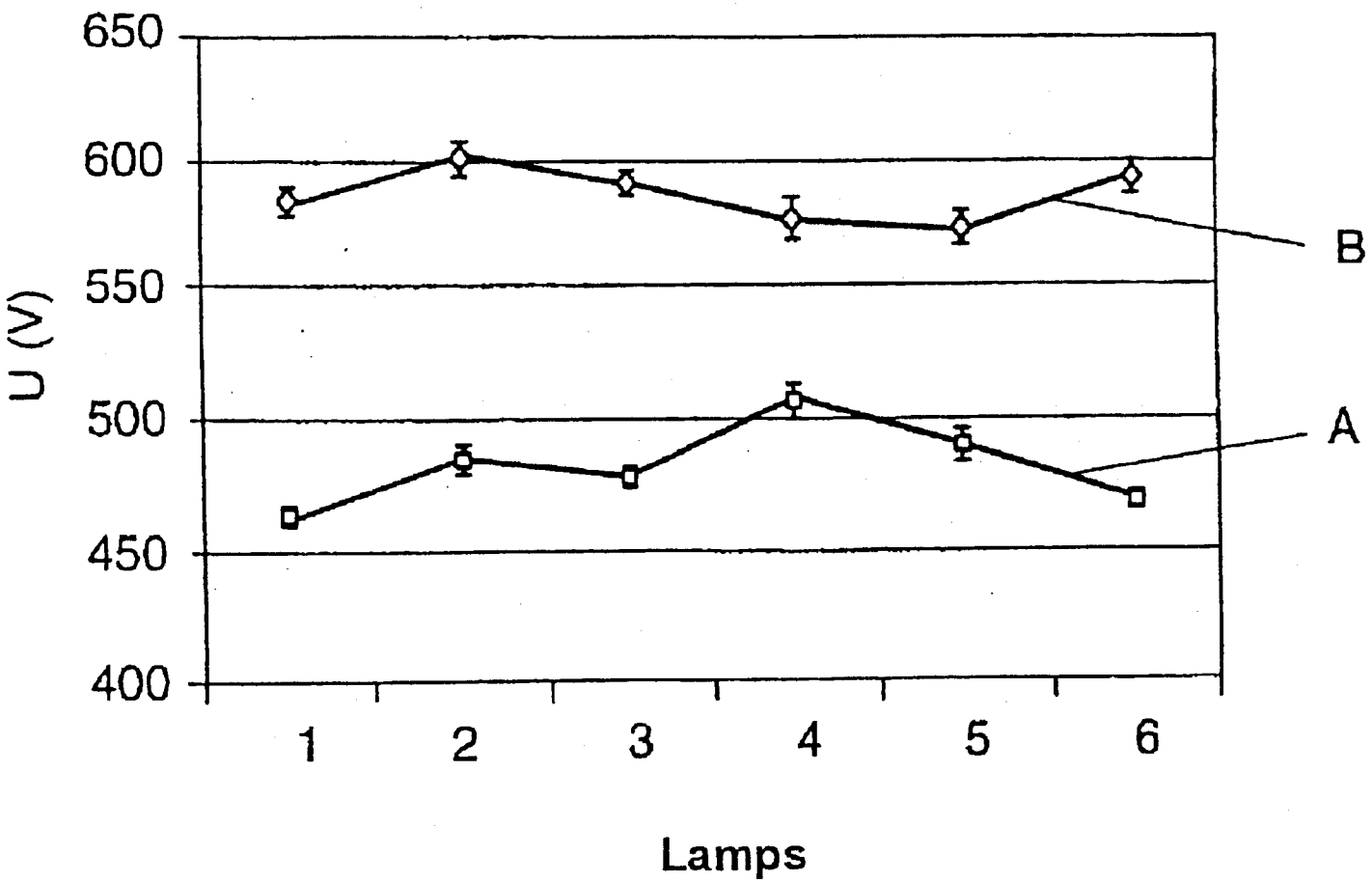
FIG. 3 shows a graph showing the firing voltage with and without coil spring for six compact low-pressure discharge lamps in accordance with FIGS. 1 and 2 with a power consumption of 42 W.

The firing voltages with coil spring 14 (values A) and without coil spring 14 (values B) for operation on an electronic ballast at an ambient temperature of 10° C. are plotted in the graph shown in FIG. 3 for six mercury-free test lamps in accordance with FIGS. 1 and 2, with a power consumption of 42 W. The graph shows that the firing voltage can be reduced by between 78 V and 129 V when the lamp 1 is equipped with a coil spring 14.

Measurements carried out on a compact low-pressure discharge lamp 1 with a power consumption of 42 W in accordance with FIGS. 1 and 2, with and without a coil spring 14 as firing aid, at an ambient temperature of 25° C., demonstrated that the use of the coil spring 14 led to a reduction in the light efficiency of around 8% for a coil spring without reflective coating and of less than 5% for a coil spring with reflective coating.

By contrast, when using a hollow cylinder made from an uncoated aluminum foil of the same length and the same diameter as the coil spring 14, the light efficiency falls by more than 10%.

What is claimed is:

1. A compact low-pressure discharge lamp (1), having a wound tubular discharge vessel made from glass, two electrodes which are fused in a gastight manner into the ends of the discharge vessel (2), a fill comprising at least one inert gas, a phosphor coating on the inner wall of the discharge vessel (2), and a cap housing (9) arranged on one side, in which lamp the discharge vessel (2) has at least four straight, parallel tubes (6, 7), the straight tubes (6, 7) are in a polygonal arrangement, the straight tubes (6, 7), close to or at the ends of the straight tubes (6, 7), are connected by transverse connections (8, 10, 11) to form a single continuous discharge path which is closed off in a gastight manner, at least the two ends of the discharge vessel (2) are secured in the cap housing (9) arranged on one side, and the cap housing (9), at the end which is remote from the discharge vessel (2), bears a contact-making system (12) for making electrical contact with the lamp (1) in a holder, characterized in that a coil spring (14) made from metal, which runs parallel to the straight tubes (6, 7), is arranged in the center of the cylindrical cavity (13) which is formed by the straight tubes (6, 7) of the discharge vessel (2) and has a reflective coating.

2. The compact low-pressure discharge lamp as claimed in claim 1, characterized in that the reflective coating of the coil spring (14) has the same reflectivity as the phosphor-coated discharge vessel (2).

3. The compact low-pressure discharge lamp as claimed in claim 1, characterized in that the coil spring (14) consists of wire with a diameter of between 0.05 and 1 mm.

4. The compact low-pressure discharge lamp as claimed in claim 1, characterized in that at least partial regions of the coil spring (14) have a diameter which is such that they bear against the outer walls of the straight tubes (6, 7) of the discharge vessel.

5. The compact low-pressure discharge vessel as claimed in claim 1, characterized in that the coil spring (14) has a pitch factor PF of $1.5<PF<70$.

6. The compact low-pressure discharge lamp as claimed in claim 1, characterized in that the coil spring (14), in the stress-free state, has a starting length which is between one and five times the distance between the transverse connections (8) of the discharge vessel (2) which are remote from the cap housing and that end of the cap housing (9) which faces the discharge vessel (2).

7. The compact low-pressure discharge lamp as claimed in claim 1, characterized in that the last turn or last turns of the coil spring (14), at the end remote from the cap housing (9), have a diameter which is such that they bear against all the straight tubes (6, 7) of the discharge vessel (2).

* * * * *